United States Patent [19]

Shea

[11] Patent Number: 5,069,260

[45] Date of Patent: Dec. 3, 1991

[54] FUEL DISPENSING NOZZLE WITH VAPOR-PROOF SEAL

[76] Inventor: Reeford P. Shea, 1021 Goldenrod, Corona del Mar, Calif. 92625

[21] Appl. No.: 646,429

[22] Filed: Jan. 28, 1991

[51] Int. Cl.[5] ..... B65B 1/04; B65B 3/04

[52] U.S. Cl. ..... 141/292; 141/207; 141/301; 141/208; 141/217; 141/351

[58] Field of Search ..... 141/301, 59, 291-295, 141/351-355, 357, 206, 207, 208, 217

[56] References Cited

U.S. PATENT DOCUMENTS

| | | | |
|---|---|---|---|
| 3,502,121 | 3/1970 | Moore et al. | 141/207 |
| 3,593,762 | 7/1971 | Johnson | 141/207 |
| 3,866,636 | 2/1975 | Lasater | 141/225 |
| 3,899,009 | 8/1975 | Taylor | 141/59 |
| 3,911,973 | 10/1975 | Casteline Jr. | 141/207 |
| 3,982,571 | 9/1976 | Fenton et al. | 141/207 |
| 4,033,389 | 7/1977 | Hansel et al. | 141/207 |
| 4,060,110 | 11/1977 | Bower | 141/207 |
| 4,143,689 | 3/1979 | Conley | 141/207 |
| 4,418,730 | 12/1983 | McMath | 141/207 |

FOREIGN PATENT DOCUMENTS

| | | | |
|---|---|---|---|
| 934344 | 9/1973 | Canada | 141/208 |

*Primary Examiner*—Henry J. Recla

*Assistant Examiner*—Keith Kupferschmid

*Attorney, Agent, or Firm*—Hawes & Fischer

[57] ABSTRACT

A lightweight, low maintenance and efficient gasoline dispensing nozzle having a nozzle spout to be inserted into the fill pipe of a motor vehicle to dispense fuel thereto from an underground storage tank while reliably preventing the escape of hydrocarbon vapors prior to and during the pumping of such fuel. The dispensing nozzle includes a resilient sealing bladder assembly which is normally spring biased to a relatively distal position at which to prevent communication between the underground tank and the atmosphere. When the nozzle spout is inserted into the fill pipe, the sealing bladder is urged axially against its spring bias to a relatively proximal position at which to release a latching assembly and thereby permit the pump handle to be depressed radially inward so that gasoline will be dispensed. In its proximal position, the sealing bladder forms a secure, vapor-tight seal against the fill pipe to prevent the escape of vapors to the atmosphere while opening a vapor recovery mouth which communicates with the underground tank by way of a vapor recovery tube. Accordingly, vapors that are displaced from the vehicle tank when fuel is dispensed thereto are forced through the vapor recovery mouth and to the storage tank via the vapor recovery tube.

15 Claims, 3 Drawing Sheets

FUEL DISPENSING NOZZLE WITH VAPOR-PROOF SEAL

BACKGROUND OF THE INVENTION

1. FIELD OF THE INVENTION

This invention relates to an improved fuel dispensing nozzle, such as that which is found at a service station to pump gasoline, and, more particularly, to an efficient vapor-proof seal and recovery system by which to reliably prevent the escape of hydrocarbon vapors into the atmosphere in accordance with air pollution abatement requirements.

2. BACKGROUND ART

A common feature of vapor recovery systems found in commercially available fuel dispensing nozzles consists of a flexible bellows or shroud surrounding the dispensing spout in a spaced concentric relationship therewith and extending from the body of the nozzle towards the dispensing end of said spout. The bellows or shroud forms an annular vent way between the bellows or shroud and the dispensing spout. The vent way extends through the nozzle body through a vapor return hose so as to return hydrocarbon vapors to an underground storage area. The sealing efficiency of the bellows-type vapor recovery system is effected by a sealing disk at the distal end of the bellows which sealingly engages the external lip of the fill pipe of a motor vehicle when the dispensing spout is inserted therein. The sealing disk is biased against the fill pipe lip by a helically wound compression spring that is disposed concentrically interior of the bellows and extended from the nozzle body to the sealing disk. The shroud-type seal is of identical operation, except that the seal is completed by the distal periphery of the shroud enveloping the radially outward portion of the vehicle fill pipe lip.

A mechanical or hydraulic interlock is usually provided to prevent the flow of gasoline until the vapor seal is completed. Also provided is a means for closing the vent way of the vapor return hose when the dispensing spout is withdrawn, thus preventing the escape of vapor from the underground storage area and into the atmosphere.

A means of attaching the dispensing nozzle to the fill pipe in the inserted and sealed position is also usually provided. Such provision commonly consists of a retainer ring secured to and extending radially outward from the dispensing spout. To engage said nozzle securing device, the operator must insert the nozzle spout into the fill pipe and past the engaging position, cock the nozzle spout out of concentricity, and then carefully release the nozzle until the retainer ring engages a radially inward extending portion of the lip of the fill pipe.

However, many of the conventional fuel dispensing nozzles are characterized as being relatively heavy and comprised of many component parts. Thus, the cost of manufacture and frequency of repair are undesirably maximized. In addition, the sealing efficiency of such conventional dispensing nozzles is sometimes unreliable so that hydrocarbon vapors will escape to the atmosphere whether the dispensing spout is inserted in or removed from the vehicle fill pipe. The engagement between the dispensing nozzle and the fill pipe is often ineffective due to the ware of the dispensing spout retainer ring or an unusual configuration of the fill pipe lip. What is more, the conventional dispensing spout is frequently plagued by premature shutoff due to increased back pressure at the spout.

Reference may be made to the following United States Patents for examples of various fuel dispensing nozzles having vapor sealing and recovery means:

| | |
|---|---|
| 3,811,486 | May 21, 1974 |
| 4,031,930 | June 28, 1977 |
| 4,060,110 | November 29, 1977 |
| 4,213,488 | July 22, 1980 |
| 4,418,730 | December 6, 1983 |

SUMMARY OF THE INVENTION

In general terms, a fuel (e.g. gasoline) dispensing nozzle is disclosed of the type that is used by service stations to pump gasoline from an underground storage tank to a fill pipe of a motor vehicle. The dispensing nozzle includes a nozzle body having a spout extending axially therefrom and communicating with the storage tank to deliver gasoline to the vehicle fill pipe. Also extending axially from the nozzle body and communicating with the storage tank is a vapor recovery vent tube which is spaced concentrically around the nozzle spout. A resilient bladder assembly is attached to and movable axially and reciprocally with a spring-biased slide assembly along the vapor recovery vent tube. The slide assembly is connected to a latch pin by way of a latch cable. Connected between the pump handle and the latch pin is a latch plate. The position of the latch pin relative to the latch plate enables the pump handle to be either locked in a radially outward position from the nozzle body to prevent the dispensing of gasoline or released to a radially inward position to allow gasoline to be dispensed.

In an at-rest condition of the dispensing nozzle, with the nozzle spout removed from a vehicle fill pipe, the bladder assembly and slide assembly are spring-biased to their distal-most position along the vapor recovery tube. Accordingly, a vapor recovery mouth located at the distal end of the vapor recovery tube is sealed by the slide assembly to prevent the escape of hydrocarbon vapor to the atmosphere. Moreover, the latch cable moves with the slide assembly to position the latch pin in locking engagement with the latch plate to prevent movement of the pump handle to which the latch plate is attached. Hence, gasoline may not be pumped in the at-rest condition of the dispensing nozzle.

In an operating condition of the dispensing nozzle, the nozzle spout is inserted into the fill pipe of the vehicle, such that said fill pipe engages and urges the bladder assembly and the slide assembly connected thereto axially and proximally along the vapor recovery tube. Accordingly, the bladder assembly forms a mechanical seal against the fill pipe to block the escape of hydrocarbon vapors therepast and prevent the inadvertent disengagement of the nozzle spout from the fill pipe. Moreover, the vapor recover mouth is opened to establish a recovery path for returning vapors that are displaced from the vehicle fill tank to the underground storage tank via the vapor recovery vent tube. What is more, the latch cable is displaced axially with the slide assembly to move the latch pin out of locking engagement of the latch plate. Accordingly, the pump handle may now be depressed in a radially inward direction to cause gasoline to be delivered through the nozzle body and into the vehicle fill pipe.

DESCRIPTION OF THE PREFERRED EMBODIMENT

Figure 1:
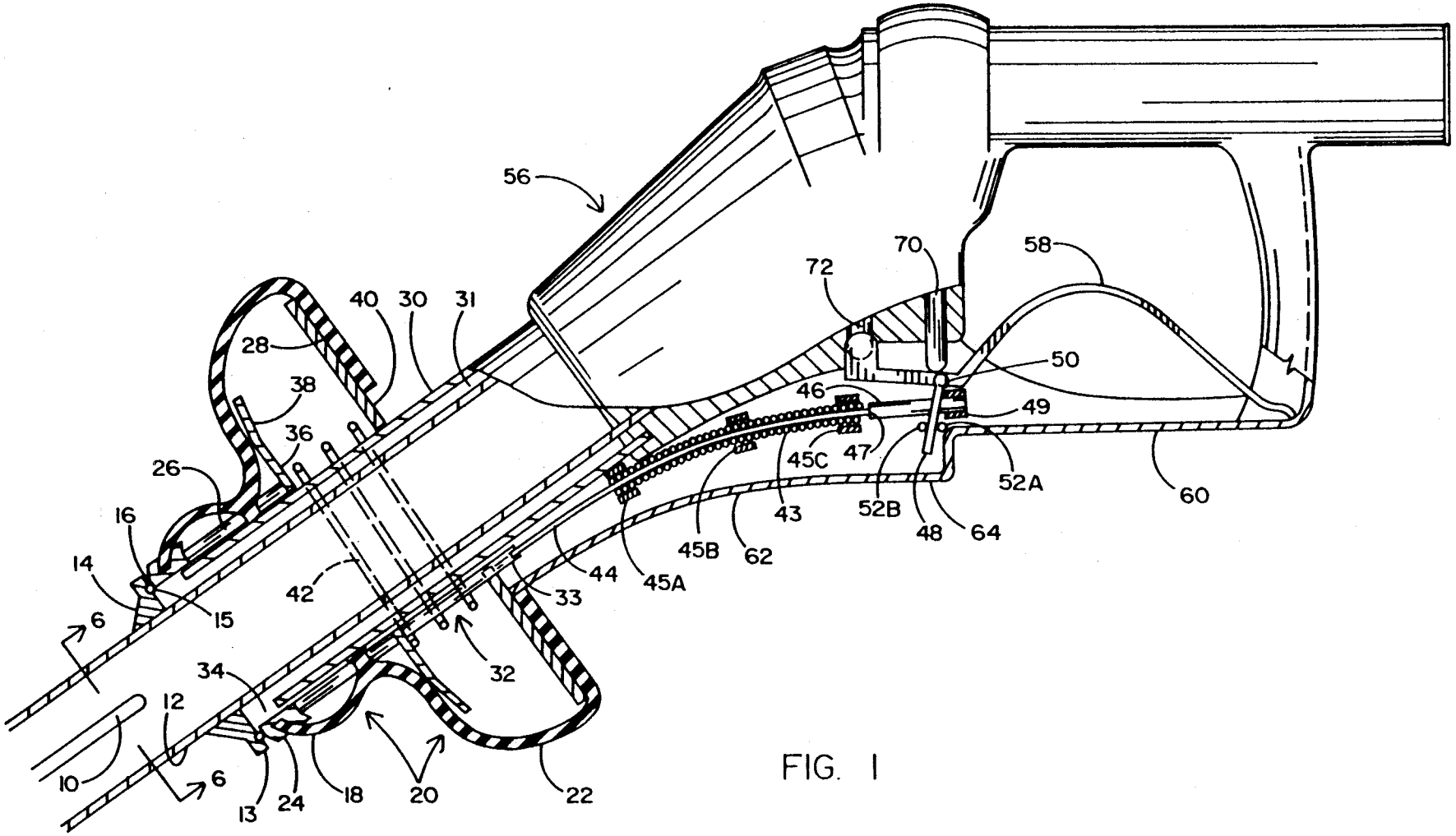
FIG. 1 is an elevational view, partly in cross-section, of the fuel dispensing and vapor recovery nozzle of the present invention in an at-rest condition prior to insertion into the fill pipe of a motor vehicle.
Figure 2:
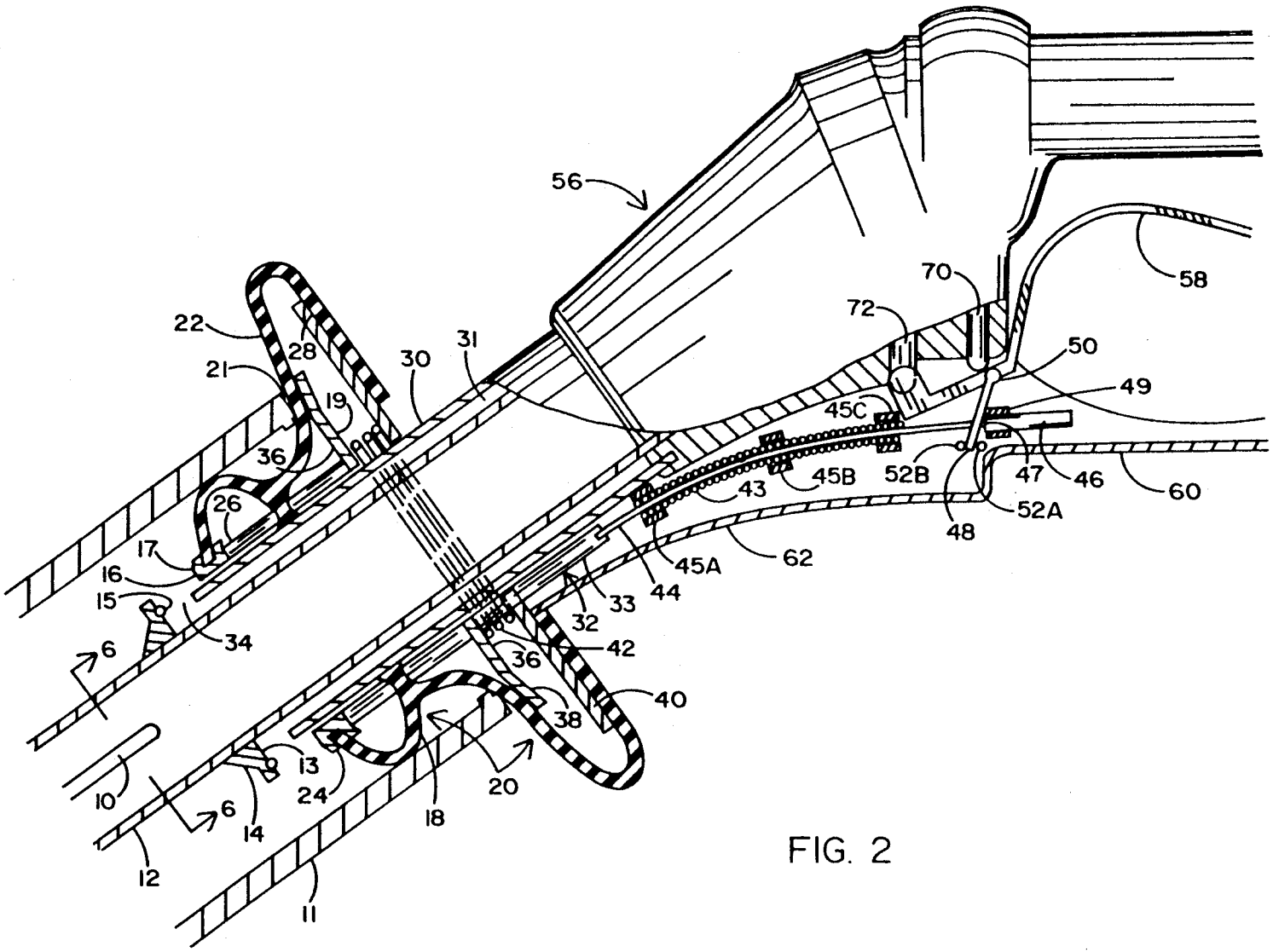
FIG. 2 is an elevational view partly in cross-section, showing the nozzle depicted in FIG. 1 in an operating condition fully inserted into a motor vehicle fill pipe.

FIGS. 1 and 2 of the drawings show the dispensing nozzle of the present invention which is of the type used to dispense fuel (e.g. gasoline) from a service station pump into the fuel tank of an automobile, or the like. The dispensing nozzle includes a nozzle body 56 having an axially extending nozzle spout 12 affixed thereto through which gasoline is dispensed. As best shown in FIG. 1, the nozzle body 56 is in an at-rest or closed condition and disposed outside an automobile fill pipe (designated 11 in FIG. 2). A pump handle 58 is hingedly attached at a first end thereof to a radially reciprocating first poppet valve shaft 72. In the at-rest condition, with no force applied to pump handle 58, poppet valve shaft 72 is biased radially inward of nozzle body 56. The handle 58 bears against a second poppet valve shaft 70 at a point between the first and opposite ends of said handle. Poppet valve shaft 70 is adapted to be displaced radially inward by means of operating handle 58. However, in the at-rest condition of FIG. 1, the handle 58 is locked radially outward of nozzle body 56, and poppet valve 70 is biased fully extended to its most radially outward position to prevent the flow of gasoline through nozzle spout 12. When it is slidably transported radially inward towards the nozzle body 56 by the radially inward rotation of the pump handle 58, the poppet valve shaft 70 acts as a fulcrum or pivot point. Therefore, the continued radially inward rotation of the handle 58 against poppet valve shaft 70 causes the poppet valve shaft 72 to be pulled radially outward from nozzle body 56 thereby allowing the flow of gasoline through nozzle spout 12.

A radially outward extending slide stop 13 is affixed to the outward wall of nozzle spout 12 at a location approximately three inches from the distal end of said spout. The slide stop 13 forms a circumferential projection extending outwardly from spout 12. An approximately 45 degree slide stop reinforcing fillet 14 is coextensively formed with the slide stop 13. Fillet 14 increases the area of the attachment of slide stop 13 to spout 12 and aids in the insertion of the spout 12 into the tank of an automobile.

A helically wound slide return spring 42 is biased proximally against a stop plate 40 and distally against a slide assembly spring bearing surface 36. In the at-rest condition of FIG. 1, spring 42 is expanded between stop plate 40 and bearing surface 36 to correspondingly urge a slide assembly 32 of nozzle 1 (best shown in FIG. 3) to move axially and distally relative to nozzle spout 12. The distal advancement of slide assembly 32 causes a slide assembly abutting surface 16 located at the distal end of the slide assembly 32 to move into sealing engagement against a resilient slide stop O-ring 15 that is supported by slide stop 14. The engagement of surface 16 against O-ring 15 prevents the escape of hydrocarbon vapor into the atmosphere.

Axially advancing the position of the slide assembly 32 correspondingly extends, in a distal direction along nozzle spout 12, a hollow (e.g. synthetic rubber) bladder assembly 20 that is connected to assembly 32 and to a vapor recovery vent tube 30 which surrounds nozzle spout 12 at the interior of bladder assembly 20. More particularly, a proximal sealing bladder 22 of bladder assembly 20 is fixed at its proximal end to the stop plate 40 by a sealing bladder attachment 28. The axial extension of the bladder assembly 20 pulls an interior distal bladder portion 18 of the bladder assembly 20 which is anchored at its distal end to slide assembly 32 at a peripherally extending bladder-to-slide attachment 24 (best shown in FIG. 3) and at its proximal end, together with the distal end of sealing bladder 22, to the vapor recovery vent tube 30 by means of a plurality of peripherally spaced attachment buttons 26. In the at-rest condition of FIG. 1, bladder portion 18 is stretched to its least radially outward position to allow an easy insertion of the nozzle spout 12 into the fill pipe of an automobile.

A slide projection 33 of the slide assembly 32 extends axially parallel to the vapor recovery vent tube 30 through the stop plate 40. Vent tube 30 also extends through and is connected to stop plate 40. Slide projection 33 is connected at one end thereof to a latch cable 44. The latch cable 44 extends through a helically wound cable guide 43. The position of cable guide 43 is secured relative to nozzle body 56 by means of axially spaced cable clamps 45A, 45B, and 45C.

The end of the cable 44 opposite its connection to the slide projection 33 of slide assembly 32 is attached to a rigid latch pin 46 at a latch attachment 47. The latch pin 46 is supported for axial displacement by a latch pin sleeve 49. In the at-rest condition of FIG. 1, the latch pin 46 is biased to its most distal position by the return spring 42 applying an axial pushing force acting through the slide projection 33 and latch cable 44. The latch pin 46 extends through a keyhole (designated 66 in FIG. 4) of a latch plate 48. The internal bore of keyhole 66 is slightly larger than the diameter of pin 46. The latch plate 48 extends radially outward from the pump handle 58 and is attached thereto by means of a latch plate hinge 50. With the position of latch plate 48 secured against displacement by its receipt of latch pin 46 in keyhole 66, the pump handle 58 is locked in a radially outward extending position during the at-rest condition of FIG. 1, and poppet valve shaft 70 is disposed radially outward of nozzle body 56 to prevent the flow of gasoline. A latch guard 64 and a handle guard 60 are attached to one another so as to surround and protect the cable 44 and the latch plate 48 to prevent the inadvertent disturbing and unlocking of pump handle 58 from the at-rest condition of FIG. 1.

FIG. 2 of the drawings shows the gasoline dispensing nozzle in an operating condition with the nozzle spout 12 fully inserted and locked into an automobile fill pipe 11. The insertion of the spout 12 into fill pipe 11 causes an outer lip of fill pipe 11 to push the sealing bladder 22 of the resilient bladder assembly 20 proximally against a cam ring 38, whereby to form a vapor tight seal therebetween. The proximal displacement of bladder assembly 20 correspondingly causes slide assembly 32 to slide axially and proximally along vapor recovery vent tube 30 towards nozzle body 56. Hence, the normally expanded return spring 42 which surrounds vent tube 30 at the interior of bladder assembly 20 is compressed between the stop plate 40 and the spring bearing surface 36 and slidably urged by stop plate 40 axially to its proximal-most position. Likewise, the interior bladder 18 of bladder assembly 20 is compressed between the bladder-to-slide and bladder-to-vent tube attachments 24 and 26 for forcing the interior bladder 18 radially outward against the fill pipe 11 thereby mechanically locking the interior bladder 18 to the inside periphery of fill pipe 11 to avoid an inadvertent disengagement of nozzle spout 12 from fill pipe 11.

Figure 6:
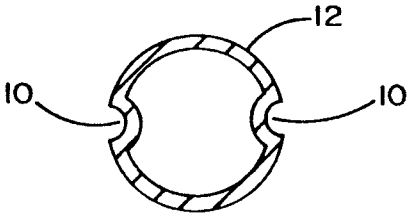
FIG. 6 is a cross-section of the nozzle spout taken along lines 6—6 of FIG. 1.

As the slide assembly abutting surface 16 of the slide assembly 32 is displaced axially and proximally towards nozzle body 56, a vapor recovery mouth 34 is opened. More particularly, the nozzle spout 12 is spaced inward from and concentrically aligned with the vapor recovery vent tube 30 which has an approximately 0.625 inches greater diameter than the nozzle spout 12. The vent tube 30 is rigidly attached to and extends distally from the nozzle body 56 adjacent the attachment of the nozzle spout 12 to said body 56. Vapor recovery vent tube 30 runs parallel to nozzle spout 12 and terminates distally of nozzle spout 12 at a point approximately 0.3125 inches from the slide stop 13. This 0.3125 space between the distal end of vapor recovery vent tube 30 and the slide stop 13 forms the aforementioned vapor recovery mouth 34. In the operating condition shown by FIG. 2, hydrocarbon vapor, which is displaced from the automobile fuel tank when fuel is dispensed thereto, is forced through the vapor recovery mouth into the space 31 between vent tube 30 and nozzle spout 12, and then through the nozzle body 56 for delivery to an underground storage tank via a vapor return hose (not shown). Vent flutes 10 are formed into the nozzle spout 12 (best illustrated in FIG. 6) to vent gasoline vapor past a no lead restrictor or other restriction formed therein so as to avoid the possibility of premature shutoff due to back pressure at the spout 12.

Figure 4:
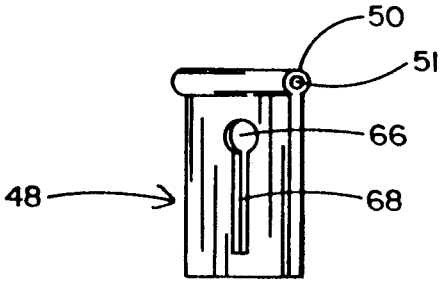
FIG. 4 is a perspective view of a latch plate of the fuel dispensing nozzle.

The proximal displacement of the slide assembly 32 along vent tube 30 is translated through the latch cable 44 to the latch pin 46 to cause pin 46 to be slidably transported through the latch pin sleeve 49, such that the distal shoulder of pin 46 is moved clear of the proximal surface of the latch plate 48 via keyhole 66 (of FIG. 4). With the latch pin 46 proximally transported beyond the keyhole 66, the latch plate 48 is released so that the pump handle 58 (and the latch plate 48 attached thereto) can be unlocked and depressed radially inward to allow normal fuel dispensing operation of the gasoline pump.

When the pump handle 58 is depressed in the operating condition of FIG. 2, the latch plate 48, by virtue of its connection to handle 58 at the latch plate hinge 50, is transported in a radially inward direction. The axial position of latch plate 48 is maintained by a proximal and distal pair of latch plate keepers 52A and 52B. Therefore, the latch plate 48 and handle 58 can be moved radially inward. However, because of the soon to be described configuration of openings in latch plate 48 (best shown in FIG. 4), the distal return of the latch cable 44 to the at rest condition of FIG. 1 is blocked by latch plate 48 until handle 58 is released to its radially outward position. Accordingly, when the pump handle 56 is depressed and gasoline is being dispensed, the spout 12 remains locked in the fill pipe 11, and the vapor recovery vent mouth 34 remains open to reliably deliver vapor to the underground storage tank in the manner previously described.

Figure 3:
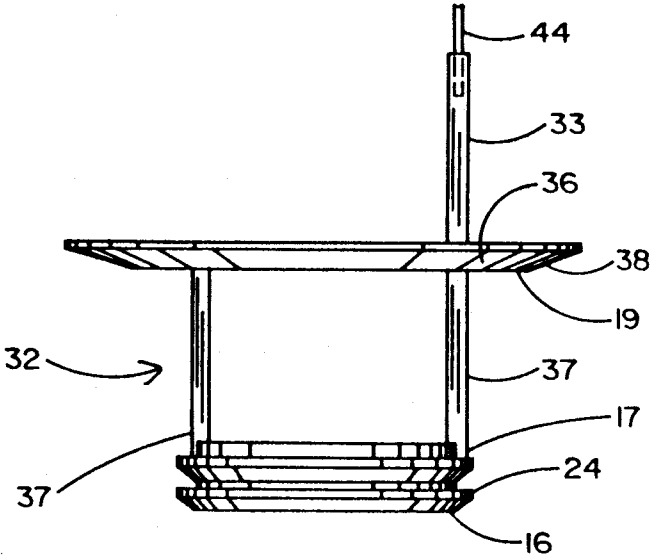
FIG. 3 is an elevational view of a slide assembly that forms the fuel dissipating nozzle.

FIG. 3 of the drawings shows the details of the slide assembly 32 according to a preferred embodiment of the invention. As previously disclosed when referring to FIG. 2, slide assembly 32 to which latch cable 44 is attached is displaced axially and proximally along vapor recovery vent tube 30 with bladder assembly 20 to open vapor recovery mouth 34 when nozzle spout 12 is inserted into fill pipe 11. A distal slide ring 17 of assembly 32 of slightly greater diameter than the diameter of vapor recovery vent tube 30 has its distal end flattened to form the slide assembly abutting surface 16. When the slide assembly 32 is moved to its distal-most position along vent tube 30 in the at-rest condition of FIG. 1, the abutting surface 16 is sealingly engaged against the resilient surface of the slide stop O-ring 15 to complete a gas-tight closure of the vapor recovery mouth 34.

On the outer face of the distal slide ring 17 is formed a groove at an approximately 45 degree angle in an inward and distal direction to establish the bladder-to-slide attachment 24. A slide ring 19, located proximally of slide ring 17, includes the spring bearing surface 36 and the cam ring 38. Spring bearing surface 36 is disk shaped with an internal bore slightly greater in diameter than the diameter of the vapor recovery vent tube 30. As previously described, spring bearing surface 36 supports one end of the slide return spring 42. The cam ring 38 extends at an approximately 22 degree angle from the outer edge of the bearing surface 36 in an outward and proximal direction.

Two or more slide spacers 37 are attached to slide assembly 32 at radially equally spaced locations flush with the inner bore of the distal slide ring 17 and the proximal slide ring 19. The interior bladder 18 of bladder assembly 20 is attached to vapor recovery vent tube 30 by the aforementioned attachment buttons 26 (of FIGS. 1 and 2) extending from assembly 20 between spacers 37 of slide assembly 32. The spacers 37 penetrate the bladder-to-slide attachment 24 (of FIGS. 1 and 2) at preformed gaps or slots therein and hold the rings 17 and 19 in a fixed axially spaced relationship slidably outward of the vent tube 30. Spacer 37 is axially aligned with the latch cable 44 and extends through the stop plate 40 to form the slide projection 33.

FIG. 4 shows the latch plate 48 with which the latch pin 46 (of FIGS. 1 and 2) is interfaced via latch cable 44. The latch plate hinge 50 (connected to pump handle 58) is traversed by a latch plate hinge pin way 51 which provides a means of hingeable attachment to handle 58. A keyhole 66 is formed through latch plate 48. Keyhole 66 has a slightly larger bore than the diameter of the latch pin 46 so that pin 46 may be received therein to lock latch plate 48 and pump handle 58 in the at-rest condition of FIG. 1 during which no gasoline is dispensed. A vertical keyway slot 68, which is of slightly larger width than the diameter of latch cable 44, is coextensively joined to keyhole 66 to receive said cable 44 therethrough, whereby latch pin 46 can be advanced proximally of latch plate 48 to release said plate 48 and permit the radially inward displacement of handle 58 and the dispensing of gasoline in the operating condition of FIG. 2.

Thus, the flow of fuel is prevented until the nozzle spout 12 is inserted into the fill pipe 11 and the latch cable 44 is displaced axially and proximally through the keyhole 66 to release latch plate 48. That is to say, when the latch pin 46 is slidably displaced beyond the proximal surface of the latch plate 48, radially inward movement of the latch plate 48 is permitted by the keyway slot 68 being of greater width than the corresponding diameter of the latch cable 44. However, the axial distal movement of the latch cable 44 and the latch pin 46 from the operating condition of FIG. 2 to the at rest condition of FIG. 1 is prevented by the latch pin 46 being of greater diameter than the width of keyway slot 68.

Figure 5:
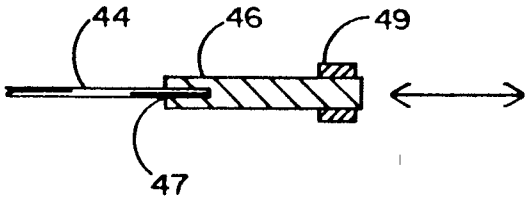
FIG. 5 is a cross-section elevational view of a latch pin which is interfaced with the latch plate of FIG. 4.

FIG. 5 of the drawings shows the proximal end of the latch cable 44 attached to the latch pin 46 by means of the cable-to-latch pin attachment 47. Also shown is the axially slidable relationship of the latch pin 46 to the latch pin sleeve 49 during the proximal displacement of the bladder assembly 20 and the slide assembly 32 to which latch cable 44 is attached at its distal end.

The gasoline dispensing nozzle of the present invention can be economically manufactured using conventional and readily available materials and processes. The assembly and maintenance are simplified by virtue of the disclosed locking mechanism (i.e. the interaction of the latch pin 46 with the latch plate 48) to control the flow of gasoline through nozzle body 56. The use of a positive mechanical means (including the resilient bladder assembly 20 interconnected with slide assembly 32) for opening and closing a vapor recovery passage provides another significant savings in manufacturing and maintenance costs. Likewise, a more reliable engagement of the automobile fill pipe 11 and seal to block escaping hydrocarbon vapor in the operating condition (of FIG. 2) is maintained by the resilient, circumferential contact of the sealing bladder 22 against the lip of the said fill pipe. What is more, the in-line insertion and removal of the nozzle spout 12 coupled with the mechanical, rather than a delicate hydraulic control of the vapor recovery passage, combine to produce a less bulky, more efficient and lower maintenance device. What is still more, time consuming and annoying premature shutoffs due to back pressure at the nozzle spout 12 caused by blockage at the no lead orifice or other constrictions are avoided by the vent flutes 10 that are formed through nozzle spout 12. Such premature shutoffs are known to be a major cause of over-filling and spilling of gasoline.

It will be apparent that while a preferred embodiment of the invention has been shown and described, various modifications and changes may be made without departing from the true spirit and scope of the invention.

Having thus set forth a preferred embodiment of the invention, what is claimed is:

1. A fuel dispensing nozzle to engage the fill pipe of a motor vehicle to supply fuel thereto, said fuel dispensing nozzle comprising a nozzle body, a nozzle spout extending axially outward from said nozzle body and communicating fluidically with a fuel storage area, and a pump handle to be moved radially relative to said nozzle body to control the flow of fuel from the storage area to the nozzle spout, said fuel dispensing nozzle further comprising, a vapor vent tube extending axially outward from said nozzle body and arranged in spaced concentric alignment around said nozzle spout so that a vapor recovery path is established therebetween, said vapor recovery path communicating fluidically with the fuel storage area;

slide assembly means slidable axially to proximal and distal positions along said vapor vent tube;

sealing means interconnected with said slide assembly means and movable axially therewith along said vapor vent tube; and biasing means adapted to move said sealing means and said slide assembly means connected thereto to said distal position along said vapor vent tube so as to close said vapor recovery path and thereby prevent the escape therethrough of hydrocarbon vapors emitted from the fuel storage area.

2. The fuel dispensing nozzle recited in claim 1, wherein said axially extending vapor vent tube has a distal end that terminates proximally of said axially extending nozzle spout, such that a vapor recovery mouth is created within said vapor recovery path between said nozzle spout and the distal end of said vent tube.

3. The fuel dispensing nozzle recited in claim 2, wherein said vapor recovery mouth is closed when said slide assembly means and said sealing means connected thereto are located at said distal position along said vapor vent tube, the closure of said mouth correspondingly closing said vapor recovery path to prevent the escape of hydrocarbon vapors therethrough to the atmosphere.

4. The fuel dispensing nozzle recited in claim 3, wherein said biasing means is a compression spring that communicates with said slide assembly means to urge said slide assembly means and said sealing means connected thereto to said distal position along said vapor vent tube to close said vapor recovery mouth and thereby isolate said vapor recovery path from the atmosphere.

5. The fuel dispensing nozzle recited in claim 4, wherein said sealing means is a hollow bladder attached to and extending outwardly from said slide assembly means, said compression spring surrounding said vapor vent tube and engaging said slide assembly means at the interior of said hollow bladder.

6. The fuel dispensing nozzle recited in claim 5, wherein said bladder has distal and proximal ends, the distal end of said bladder connected to said slide assembly means to move axially therewith along said vapor vent tube, and a portion of said bladder intermediate said distal and proximal ends fixedly connected to said vapor vent tube, such that an area of said bladder located between said distal end and said intermediate portion forms a first seal extending radially outward for receipt against the inside of the fill pipe of the motor vehicle for securing said dispensing nozzle to said fill pipe and opening said vapor recovery path when the distal end of said bladder is engaged by said fill pipe and moved thereby with said slide assembly means against said biasing means and proximally along said vent tube.

7. The fuel dispensing nozzle recited in claim 6, wherein the proximal end of said bladder is fixedly interconnected with said vapor vent tube, such that an area of said bladder between said intermediate portion and said proximal end forms a second seal extending radially outward for receipt against the fill pipe of the motor vehicle for isolating said fill pipe from the atmosphere and placing said fill pipe and said vapor recovery path in fluid communication with one another and with the fuel storage area when the distal end of said bladder is engaged by said fill pipe and moved thereby against said biasing means and proximally along said vent tube and said vapor recovery path is opened.

8. The fuel dispensing nozzle recited in claim 1, further comprising a latching assembly connected between the pump handle and said slide assembly means and movable with said slide assembly means, said latching assembly retaining said pump handle radially outward from said nozzle body to prevent the flow of gasoline from said dispensing nozzle when said slide assembly means is moved to said distal position along said vapor vent tube, said latching assembly releasing said pump handle to be displaced radially inward towards said nozzle body to permit the flow of gasoline when said slide assembly means is moved against said biasing means to said proximal position along said vapor vent tube.

9. The fuel dispensing nozzle recited in claim 8, further comprising a cable connected between said slide assembly means and said latching assembly to transfer the axial movement of said slide assembly means to said latching assembly.

10. The fuel dispensing nozzle recited in claim 9, wherein said latching assembly includes a latch plate connected to the pump handle and movable radially therewith relative to the nozzle body and a latch pin connected to said cable and movable axially with said slide assembly means into detachable engagement with said latch plate.

11. The fuel dispensing nozzle recited in claim 10, wherein said latch plate includes a relatively wide keyhole within which to receive said latch pin when said slide assembly means is moved to said distal position along said vapor vent tube so as to retain the pump handle in said radially outward position, and a relatively narrow slot communicating with said keyhole within which to receive said cable when said slide assembly means is moved to said proximal position along said vent tube to push said latch pin proximally and outwardly of said keyhole so as to release the pump handle to be displaced radially inward towards the nozzle body.

12. The fuel dispensing nozzle recited in claim 1, further comprising openings formed through the nozzle spout to minimize back pressure when said dispensing nozzle engages the fill pipe of the motor vehicle.

13. A fuel dispensing nozzle to engage the fill pipe of a motor vehicle to supply fuel thereto, said fuel dispensing nozzle comprising a nozzle body, a nozzle spout extending axially outward from said nozzle body and communicating fluidically with a fuel storage area, and a pump handle to be moved radially relative to said nozzle body to control the flow of fuel from the storage area to the nozzle spout, said fuel dispensing nozzle further comprising, a vapor vent tube extending axially outward from said nozzle body and arranged in spaced concentric alignment around said nozzle spout so that a vapor recovery path is established therebetween, said vapor recovery path communicating fluidically with the fuel storage area;

sealing means movable axially between distal and proximal positions along said vapor vent tube; and biasing means interconnected with said sealing means and adapted to move said sealing means to said distal position along said vapor vent tube at which to close the vapor recovery path and isolate said path from the atmosphere to prevent the escape of hydrocarbon vapors therethrough from the fuel storage area, said sealing means being urged by the fill pipe of the motor vehicle against said biasing means and to said proximal position along said vapor vent tube when said dispensing nozzle engages said fill pipe, said sealing means opening said vapor recovery path at said proximal position and forming a seal against said fill pipe to secure said fuel dispensing nozzle to said fill pipe and isolate said fill pipe from the atmosphere, such that said fill pipe and said vapor recovery path are placed in fluid communication with one another to convey hydrocarbon vapors carried by said fill pipe to the fuel storage area by way of said vapor recovery path.

14. The fuel dispensing nozzle recited in claim 13, further comprising a latching assembly interconnected between the pump handle and said sealing means and movable with said sealing means, said latching assembly retaining said pump handle radially outward from said nozzle body to prevent the flow of gasoline from said dispensing nozzle when said sealing means is moved to said distal position along said vapor vent tube, said latching assembly releasing said pump handle to be displaced radially inward towards said nozzle body to permit the flow of gasoline when said sealing means is moved against said biasing means to said proximal position along said vapor vent tube.

15. The fuel dispensing nozzle recited in claim 14, wherein said latching assembly includes a latch plate connected to the pump handle and movable radially therewith relative to the nozzle body and a latch pin interconnected and movable with said sealing means into detachable engagement with said latch plate, the attachment of said latch pin to said latch plate preventing the radial movements of said latch plate and said pump handle and the flow of gasoline from said dispensing nozzle.

* * * * *